US009644923B2

(12) United States Patent
Andresen

(10) Patent No.: US 9,644,923 B2
(45) Date of Patent: May 9, 2017

(54) COMPOSITE, PROTECTIVE FABRIC AND GARMENTS MADE THEREOF

(71) Applicant: Lars Petter Andresen, Oslo (NO)

(72) Inventor: Lars Petter Andresen, Oslo (NO)

( * ) Notice: Subject to any disclaimer, the term of this patent is extended or adjusted under 35 U.S.C. 154(b) by 0 days.

(21) Appl. No.: 14/992,829

(22) Filed: Jan. 11, 2016

(65) Prior Publication Data

US 2017/0003104 A1 Jan. 5, 2017

Related U.S. Application Data

(63) Continuation-in-part of application No. 14/791,059, filed on Jul. 2, 2015, now abandoned.

(51) Int. Cl.

| | |
|---|---|
| ***F41H 1/02*** | (2006.01) |
| ***A41D 19/015*** | (2006.01) |
| ***A41D 1/04*** | (2006.01) |
| ***A41D 1/06*** | (2006.01) |
| ***A41D 31/00*** | (2006.01) |

(52) U.S. Cl.

CPC ..... *F41H 1/02* (2013.01); *A41D 1/04* (2013.01); *A41D 1/06* (2013.01); *A41D 19/01511* (2013.01); *A41D 31/0061* (2013.01)

(58) Field of Classification Search

CPC .... F41H 1/02; A41D 1/04; A41D 1/06; A41D 19/01511; A41D 31/0061

See application file for complete search history.

(56) References Cited

U.S. PATENT DOCUMENTS

| | | | | |
|---|---|---|---|---|
| 4,320,081 | A | 3/1982 | Lammers | |
| 4,779,290 | A * | 10/1988 | Welch | A41D 19/0058 2/161.6 |
| 5,113,532 | A * | 5/1992 | Sutton | A41D 19/0058 2/16 |
| 5,146,628 | A * | 9/1992 | Herrmann | B29C 41/003 2/16 |
| 5,200,256 | A * | 4/1993 | Dunbar | B32B 15/14 109/49.5 |
| 5,564,127 | A * | 10/1996 | Manne | A41D 19/0058 2/161.7 |
| 6,457,182 | B1 * | 10/2002 | Szczesuil | A41D 19/01511 2/16 |
| 6,581,212 | B1 * | 6/2003 | Andresen | A41D 19/01511 139/425 R |
| 2005/0050619 | A1 * | 3/2005 | Dunn | A41D 31/0027 2/458 |
| 2006/0277651 | A1 * | 12/2006 | Razzaghi | A41D 13/0002 2/81 |
| 2008/0307553 | A1 | 12/2008 | Jbeiliet | |

(Continued)

*Primary Examiner* — Shaun R Hurley
*Assistant Examiner* — Andrew W Sutton
(74) *Attorney, Agent, or Firm* — r.r (princeton); Roy Rosser

(57) ABSTRACT

A composite, protective fabric, and garments made thereof, are disclosed. The composite fabric has microflex layers of woven para-aramid yarn placed in proximity to metallic mesh layers of woven stainless steel mesh. The individual poly-p-phenylene terephthalamide fibers in the para-aramid yarn have a denier of less than or equal to 2 dtex. The metallic mesh layers are woven from stainless steel fibers having a diameter of 0.2 mm or less and have a mesh aperture of 0.45 mm or less. The garments made using the fabric include glove, bullet proof vests and chain-saw resistant trousers.

6 Claims, 5 Drawing Sheets

(56) References Cited

U.S. PATENT DOCUMENTS

| | | | | |
|---|---|---|---|---|
| 2009/0222980 | A1* | 9/2009 | Klug | A41D 19/01529 2/455 |
| 2009/0255022 | A1* | 10/2009 | Smith | B29C 43/20 2/2.5 |
| 2011/0237146 | A1* | 9/2011 | Zumloh-Nebe | D02G 3/04 442/308 |
| 2012/0079640 | A1* | 4/2012 | Carlston | A63B 71/14 2/2.5 |
| 2012/0180196 | A1* | 7/2012 | Tock | A41B 11/02 2/239 |
| 2012/0185997 | A1* | 7/2012 | Kirk, II | A62B 17/006 2/161.7 |
| 2012/0317693 | A1* | 12/2012 | Hatz | A41D 19/01582 2/16 |
| 2014/0075639 | A1* | 3/2014 | Albertyn | A41D 19/01505 2/16 |
| 2014/0115750 | A1* | 5/2014 | Kassam | B29C 41/14 2/159 |
| 2014/0260937 | A1* | 9/2014 | Whitaker | F41H 5/013 89/36.02 |
| 2014/0283273 | A1* | 9/2014 | Falken | A41D 13/012 2/2.15 |
| 2015/0121598 | A1* | 5/2015 | Mathews | A41D 19/001 2/16 |
| 2015/0164158 | A1* | 6/2015 | Veillet | A41D 19/015 2/161.6 |
| 2015/0203995 | A1* | 7/2015 | Adams | D03D 1/0035 2/455 |

* cited by examiner

COMPOSITE, PROTECTIVE FABRIC AND GARMENTS MADE THEREOF

CROSS-REFERENCE TO RELATED APPLICATIONS

This application is related to, and is a Continuation-in-Part of co-pending U.S. patent application Ser. No. 14/791,059 entitled "Stretchable Metal Mesh Protective Material and Garments" filed on 2 Jul. 2015, the contents of which are hereby incorporated by reference in their entirety.

BACKGROUND OF THE INVENTION (1) Field of the Invention

The invention relates to a composite fabric having superior cut and puncture resistance, and more particularly to a fabric made of a combination of layers of stainless steel mesh and layers of woven, para-aramid fibers and the use of that composite fabric in constructing protective garments.

(2) Description of Related Art

Fabrics woven from para-aramid synthetic fibers such as, but not limited to, Kevlar™ display exceptional resistance to ballistic puncture and have been used successfully to construct light weight, bullet proof body armor. The materials are, however, only of average resistance to cut and slash attacks and to puncture by needles. The para-aramid based body armor, therefore, provides good protection against gun attacks, but is not particularly effective against knife or needle threats.

What is needed is a light-weight fabric that provides a combination of high resistance to ballistic puncture, cut and slash attacks and puncture attacks, and which can be readily used to fabricate light weight, flexible garments such as, but not limited to, gloves and attack proof vests.

The relevant prior art includes:

U.S. Pat. No. 6,581,212 issued to Andresen on Jun. 24, 2003 entitled "Protective garment" that describes a protective garment for protection of body parts against cuts or puncture wounds comprising an inner layer, a protective layer and an outer layer, the protective layer being composed of a wire mesh of woven metal wires, the thickness of the metal wires being between 0.03 mm and 0.20 mm and the apertures in the wire mesh being between 0.05 mm and 0.45 mm.

US Patent Application 20080307553 submitted by Terrance Jbeiliet al. published on Dec. 18, 2008 entitled "Method and Apparatus for Protecting against Ballistic Projectiles" that describes a composite material comprising a multitude of masses and fibers supported on a flexible substrate arranged in a manner to absorb energy from a ballistic projectile and thereby protect persons or property from ballistic injury or damage. An array of small, tough disc-like masses are suspended in a three dimensional cradle of high-tensile elastomeric fibers such that energy from an incoming ballistic projectile is first imparted to one or more masses and the motion of the masses are restrained by tensile strain of elastomeric fibers substantially in the direction of travel of the incoming projectile. The projectile is eventually decelerated to harmless velocity through a combination of transfer of momentum to the masses and the elastic and plastic tensile deformation of the fibers. One or more layers of the composite material can be assembled to form body protective armor ("bullet-proof vest") or property protective armor, the number and characteristics of the layers being adjusted according to the specific ballistic threat anticipated.

Various implementations are known in the art, but fail to address all of the problems solved by the invention described herein. Various embodiments of this invention are illustrated in the accompanying drawings and will be described in more detail herein below.

BRIEF SUMMARY OF THE INVENTION

An inventive composite, protective fabric, and garments made thereof, are disclosed.

A layer of woven para-aramid yarn, herein termed a "microflex" layer, placed in proximity to a layer of woven stainless steel mesh, herein termed a "metallic mesh" layer, produces a composite material having the surprising property of a puncture resistance that is 30%-40% greater than that expected from a linear combination of the cut and puncture resistance properties of each individual layer, while maintaining the combined ballistic and needle protection of each layer. The unexpectedly effective composite material of the present invention, therefore, combines high levels of ballistic, cut, stab and needle protection while being sufficiently lightweight and flexible for use in wearable protective garments.

In a preferred embodiment for use in producing garments, one or microflex layers may be placed in proximity with one or more layers of metallic mesh layer, sandwiched between an inner and an outer protective layer that may be joined at the periphery of the protective layers.

The microflex layers are preferably made of a woven para-aramid yarn, where the individual fibers in the yarn comprise fibers having a denier of less than or equal to 2 dtex and more preferably a dernier of 0.55 dtex. The para-aramid fibers are preferably comprised of poly-p-phenylene terephthalamide and may have a tenacity of at least 10 cN/dtex, an elongation at break of at least 2.7% and an initial modulus of at least 300 cN/dtex, and may be formed into a yarn of 500 or more fibers for weaving.

In a preferred embodiment, the metallic mesh layers are preferably woven from stainless steel fibers having a diameter of 0.2 mm or less and may have a mesh aperture of 0.45 mm or less.

As described in more detail below, the number and arrangement of the micromesh and metallic mesh layers may be adjusted in various ways to suit the material for its use in the manufacture of various wearable protective garments such as, but not limited to, gloves, attack resistant vests, protective trousers and protective leggings.

Therefore, the present invention succeeds in conferring the following, and others not mentioned, desirable and useful benefits and objectives.

It is an object of the present invention to provide improved wearable protective garments capable of a combination of high level ballistic, cut and slash, puncture and needle protection.

It is another object of the present invention to provide cost effective, lightweight materials for protective garments.

BRIEF DESCRIPTION OF THE SEVERAL VIEWS OF THE DRAWINGS

FIG. 9 B shows a schematic, plan view of an assembled fan, 3-piece glove pattern of one embodiment of the present invention.

FIG. 10 B shows a schematic, plan view of an assembled turkey, 3-piece glove pattern of one embodiment of the present invention.

DETAILED DESCRIPTION OF THE INVENTION

Figure 1:
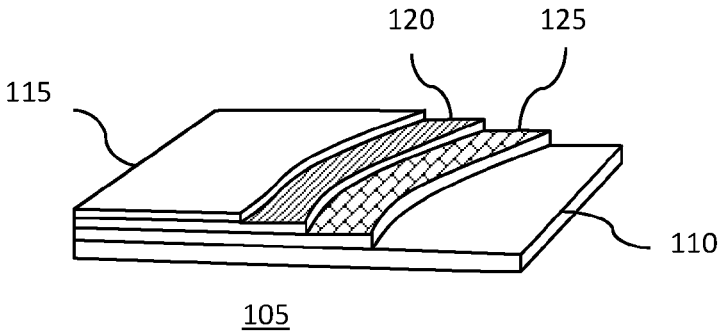
FIG. 1 shows a schematic cut-away isometric view of the layers of a protective, composite fabric of one embodiment of the present invention.

The preferred embodiments of the present invention will now be described in more detail with reference to the drawings in which identical elements in the various figures are, as far as possible, identified with the same reference numerals. These embodiments are provided by way of explanation of the present invention, which is not, however, intended to be limited thereto. Those of ordinary skill in the art may appreciate upon reading the present specification and viewing the present drawings that various modifications and variations may be made thereto.

FIG. 1 shows a schematic cut-away isometric view of the layers of a protective, composite fabric 105 of one embodiment of the present invention.

The protective, composite fabric 105 may, for instance, have a microflex fabric layer 120 adjacent to a metal mesh layer 125 with both layers sandwiched between an outer protective layer 115 and an inner protective layer 110. The inner and outer protective layers may be any fabric suitable for wearing in a garment such as, but not limited to, a fabric woven from cotton, wool, silk, linen, polyester or some combination thereof.

In a preferred embodiment, the microflex fabric layer 120 is preferably made of woven para-aramid yarn. Para-aramid yarns are well-known and sold by, for instance, E. I. du Pont de Nemours and Company of Wilmington, Del. under the tradename Kevlar™ and Teijin Aramid of Arnhem, Netherlands under the tradename Twaron™. Woven para-aramid fabrics have become widely used in body-armor because of their high resistance to ballistic penetration. Such fabrics are, however, susceptible to puncture type penetration, particularly cut and slash penetration and to needle stick penetration.

The metal mesh layer 125 is preferably a woven metallic mesh, and more preferably a woven mesh of stainless steel fibers having a diameter of 0.2 mm or less and a mesh aperture of 0.45 mm or less. Such a mesh has been found to have good resistance to cut and slash penetration and to needle stick penetration, and has been used in protective garments such as, but not limited to, protective gloves, as described in, for instance, U.S. Pat. No. 6,581,212 issued to Andresen on Jun. 24, 2003, the contents of which are hereby incorporated by reference in their entirety. However, the number of metal mesh layers 125 of the type described above that may be needed to provide, for instance, adequate puncture penetration may result in garments such as, but not limited to, protective gloves, that may not have as much flexibility as desired or may be more costly to produce than desired.

In investigating methods of improving protective garments such as gloves, a trial combination of a fabric combining a microflex fabric layer 120 with a metal mesh layer 125 was found to have an unexpected property. The puncture resistance of the combined layers was found to be 30-40% greater than what would be expected from an additive combination of the puncture resistance of the two individual layers. This surprising and unexpected finding may allow lighter, cheaper and more flexible garments to be constructed from the composite material.

While the exact mechanism for this unexpected improvement in the material properties of the composite material may, as yet, not be fully understood, several factors may be of significance.

It is well-know that the ballistic stopping power of poly-aramid materials is a result of their absorbing the kinetic energy of the impacting missile. A bullet, for instance, on impacting the fabric has its kinetic energy absorbed in breaking the poly-aramid strands as it attempts to penetrate the material. The strands essentially attach themselves to the bullet, absorbing the bullets kinetic energy as they are stretched to their breaking point. To maximize the interaction between the bullet and the material, makers of poly-aramid fabrics attempt to make the fibers of poly-aramid as small as possible thereby increasing the "working surface" of the fibers that interact with the bullet.

The preferred Kevlar™ fabric used for bullet proof vests in, for instance, made from Kevlar 29 yarn. Kevlar 29 yarn is made of approximately 1000 fibers wound together to form a yarn having a denier of approximately 1,500 dtex. ("Denier" is both a standard measurement of filament size and a term used more loosely to merely say "filament size". The unit "dtex" is an internationally recognized measure of yarn or filament size and is the weight in grams of 10,000 meters of the yarn or filament). A 1000 filament yarn having a denier of 1,500 dtex implies a denier for the individual fibers of about 1.5 dtex.

Teijin Aramid's recommended yarn for weaving into bullet proof vest is their Twaron™ Microfilament yarn. Their 2040 Microfilament fiber, for instance, consists of 500 fibers wound together for a yarn having a dernier of 550 dtex, implying a fiber dernier of 1.1 dtex. They also supply an Ultra Micro version of Twaron™ that is a yarn having 500 filaments and a fiber dernier of 550 dtex, implying a filament dernier of 0.55 dtex.

The puncture resistance synergy of the microflex fabric layers 120 and the metal mesh layers 125 may be more pronounced when the fiber size of the para-aramid fibers is smallest. This may be indicative of some interaction occurring between the two layers during a puncture attack. This interaction may, for instance, be the para-aramid fibers being forced through or past the metal fibers of the mesh. The kinetic energy expended in stretching the para-aramid fibers through the mesh may be the explanation for the synergistic behavior of the two layers that produces the surprisingly better puncture resistance of when the two are combined as a composite material.

In a preferred embodiment of the present invention the para-aramid fibers may, therefore, be poly-p-phenylene terephthalamide fibers having a fiber dernier of 2 dtex or less that may be bundled, for weaving, into a yarn having 500 or more fibers, with the yarn having a strength at break of 200 N or more, a tenacity at break of 2.3 mN/tex or more and an elongation at break of between 3.4% and 3.8%. In a more preferred embodiment of the present invention, the fiber dernier may be 1.1 dtex or less, and a most preferred embodiment may have a fiber dernier of 0.55 dtex or less.

In a preferred embodiment, the microflex fabric layers 120 and the metal mesh layers 125 may be sandwiched between an outer protective layer 115 and an inner protective layer 110, and the inner and outer protective layers may be joined at a periphery of a garment piece by, for instance, stitching or by some other joining mechanism such as, but not limited to, gluing, welding, stapling or some combination thereof.

Figure 2:
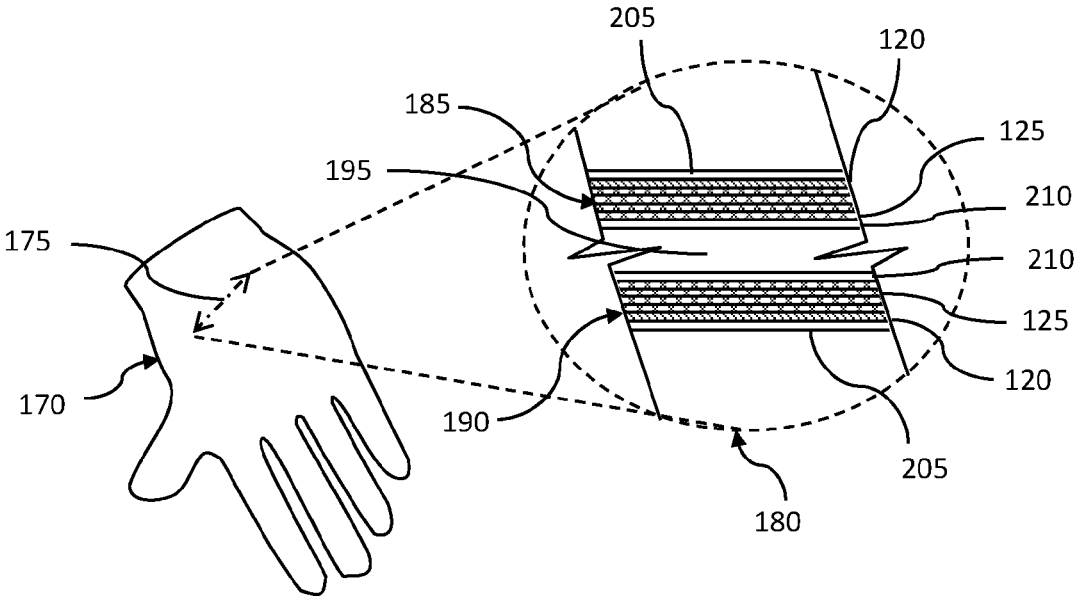
FIG. 2 shows a schematic plan view of a protective glove of one embodiment of the present invention, and a schematic cross-section of a selected portion of the glove.

FIG. 2 shows a schematic plan view of a protective glove 170 of one embodiment of the present invention, and a schematic cross-section of a selected portion 180 of the glove 170.

The partial cross section 180 of the glove is shown as taken on a line 175. The partial cross section 180 of a glove shows a top portion 185 of a glove and a lower portion 190 of a glove separated by a space 195 for a hand. The top portion 185 of the glove is shown as having an outer protective layer 205 and an inner protective layer 210 between which are sandwiched a plurality of metal mesh layers 125 and a microflex fabric layer 120. The lower portion 190 of a glove is similarly shown with the metal mesh layers 125 and the microflex fabric layers 120 sandwiched between an outer protective layer 205 and an inner protective layer 210. In both the top and the bottom portions of the glove, the inner protective layer 210 is shown closest to the space 195 for a hand and the microflex fabric layers 120 are shown proximate to the inner protective layer 210. Such an arrangement may, for instance, provide a material well suited to resisting puncture attack from the outside of the glove.

FIG. 2 shows four metal mesh layers 125 and one microflex fabric layers 120. While such an arrangement may, for instance, yield an economical glove that meets certain performance levels such as, but not limited to, the EN388 test for abrasion resistance, blade cut resistance, tear resistance and puncture resistance, there may be other arrangements that may be more advantages in terms of factors such as, but not limited to, cost, performance, flexibility and comfort, or some combination thereof.

The composite material may, for instance, have a plurality of microflex fabric layers 120 and metal mesh layers 125 that may be alternated with each other. Such an arrangement may, for instance, increase the hypothesized synergy between the layers described above.

The composite material may, for instance, have one or more layers of microflex fabric layers 120 adjacent to both the outer protective layer 205 and the inner protective layer 210 on either or both of the top portion 185 of a glove and the lower portion 190 of a glove. Such an arrangement may, for instance, increase the resistance of the inside of the glove to rupturing through flexing.

Figure 3:
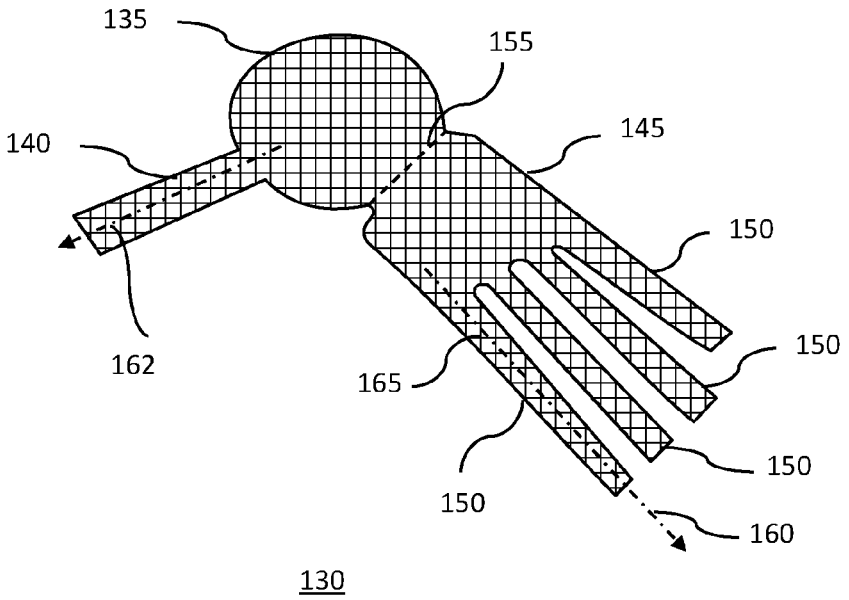
FIG. 3 shows a schematic, plan view of an elephant-pattern cut-out of one embodiment of the present invention.

FIG. 3 shows a schematic, plan view of an elephant-pattern 130 cut-out of one embodiment of the present invention.

The elephant-pattern 130 may, for instance, have a first palm region 135 with an integral thumb extension 140 that may be attached via a lower palm edge 155, to a second palm region 145 having one or more finger extensions 150. The attachment of the first palm region 135 to the second palm region 145 may, for instance, be via a lower palm edge 155.

In a preferred embodiment of the present invention, the fabric to be cut into the elephant-pattern 130 may be arranged such that one or more of the finger extensions 150 are bias-cut 165 with respect to a direction 160 of that finger extension. Such an arrangement may have the advantage of increased flexibility of the finger portion of the glove.

In a preferred embodiment of the elephant-pattern 130, the shape is such that when the fabric is arranged such that one or more of the finger extensions are bias-cut with respect to the direction of that finger extension, the thumb extension 140 is also bias cut with respect to a direction 162 of the thumb extension.

In a preferred embodiment, the bias-cut may only be used for the metal mesh layers 125 as bias-cutting tends to produce more waste. There may, however, be situations where the additional flexibility introduced by bias-cutting makes it a preferred method even for one or more of the microflex fabric layers 120. For instance, in an application required multiple microflex fabric layers 120, the combined effect of many layers may be to provide a fabric that is too stiff in a particular direction and bias-cutting of one or more of the microflex fabric layers 120 may provide a more acceptable and wearable garment.

Figure 4:
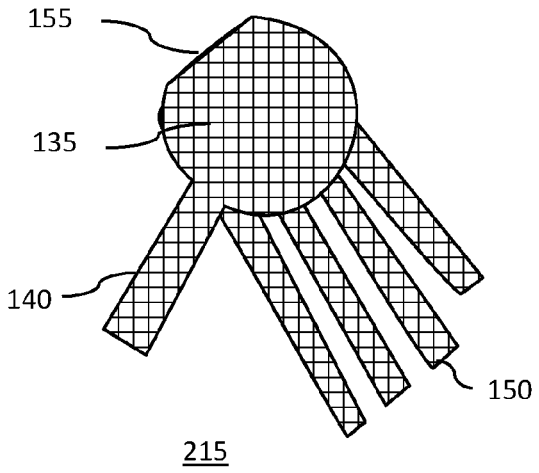
FIG. 4 shows a schematic, plan view of a folded, elephant pattern layer of one embodiment of the present invention.

FIG. 4 shows a schematic, plan view of a folded, elephant pattern layer 215 of one embodiment of the present invention.

The folded, elephant pattern layer 215 is shown folded along a lower palm edge 155 that joins the two palm regions of the elephant pattern so that the structure is now ready to be used in a glove. The folded, elephant pattern layer 215 has the added advantage that the palm region of the glove, which may be the most vulnerable portion of the glove with respect to puncture, has a double layer of metal mesh.

Figure 5:
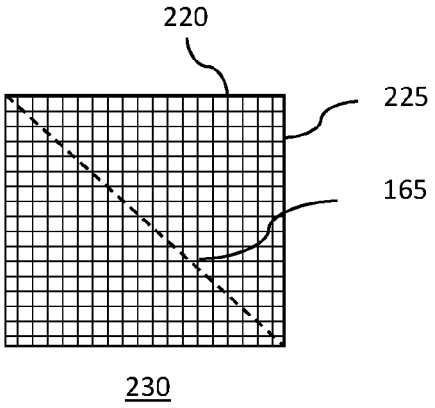
FIG. 5 shows a schematic view of a bias-cut on a woven fabric.

FIG. 5 shows a schematic view of a bias-cut on a woven fabric 230. As shown, the bias-cut 165 is at approximately forty-five degrees with respect to both the warp thread 220 and the weft thread 225 of the woven fabric.

Figure 6:
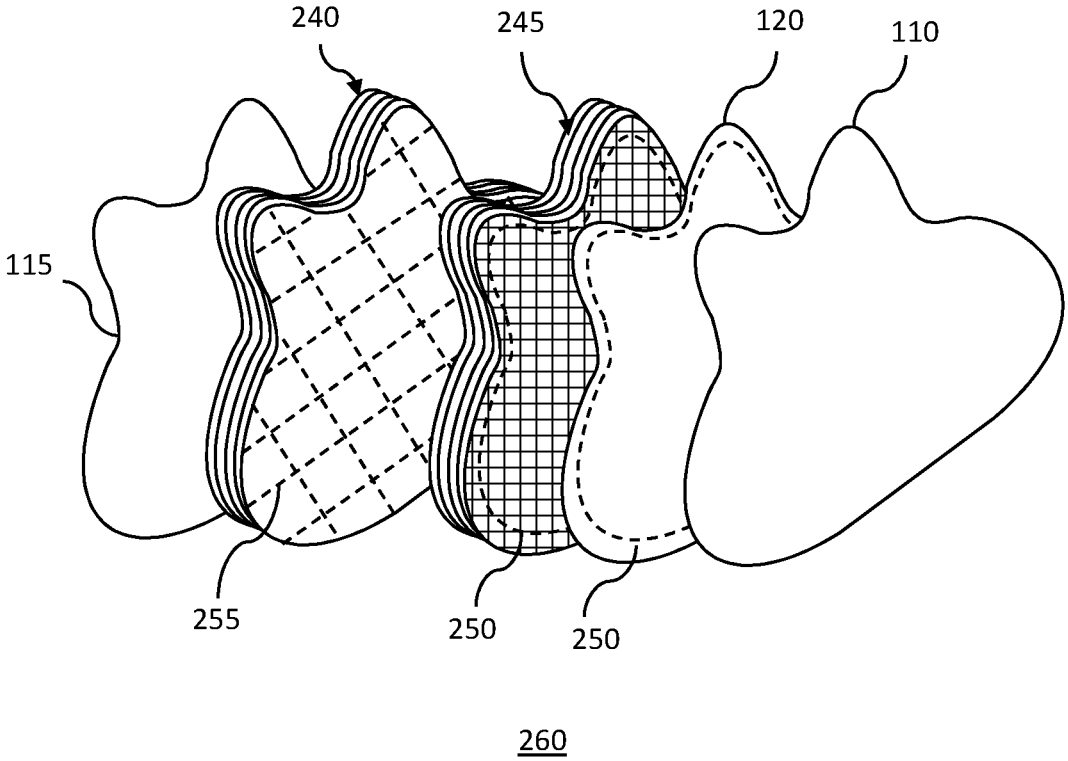
FIG. 6 shows a schematic, exploded isometric view of the components of a portion of a protective vest of one embodiment of the present invention.

FIG. 6 shows a schematic, exploded isometric view of the components of a portion of a protective vest 260 of one embodiment of the present invention.

As shown in FIG. 6, a chest or back portion of a protective vest 260 may have an outer protective layer 115, a plurality of microflex layers 240 adjacent to the outer protective layer 115, a plurality of metal mesh layers 245 and an inner protective layer 110. When the garment is worn with the inner protective layer 110 closest to the wearer, this arrangement may provide good protection against a ballistic attack on the wearer.

The outer and inner protective layers may be made of a suitably wearable fabric such as, but not limited to, cotton, denim, wool, silk, linen, bamboo, or some combination thereof.

The plurality of microflex layers 240 may be joined to each other by stitching extending across the interior 255. The plurality of metal mesh layers 245 may, in contrast, be joined to each other by being peripherally sewn 250. The joining may also or instead be accomplished by a means such as, but not limited to, gluing, welding, stapling, or some combination thereof.

In a preferred embodiment, the plurality of metal mesh layers 245 may also have one or more microflex fabric layers 120 attached to them by being peripherally sewn 250. These layers may be on either side of the plurality of metal mesh layers 245 or on both sides. The microflex fabric layers 120 peripherally attached to the peripherally sewn 250 may, for instance, provide enhanced protection against puncture attacks such as, but not limited to, stab, cut, slash and needle attacks, or some combination thereof.

In a preferred embodiment of the present invention there may be between 20 and 28 microflex fabric layers 120 and between 8 and 12 metal mesh layers 125, and in a more preferred embodiment there are 24 microflex fabric layers 120 and 10 metal mesh layers 125.

One of ordinary skill in the art will, however, appreciate that the protective, composite fabric illustrated in FIG. 6 and described above may be used in a variety of other protective garments. For instance, trousers or legging made incorporating such a material may, for instance, offer significant protection against puncture attacks such as those of industrial cutting machinery such as, but not limited to, a chainsaw. Similarly, the material, or variants of it, may be incorporated into other items of protective apparel such as, but not limited to, shoes, boots, gloves, head-gear or sleeves.

Figure 7:
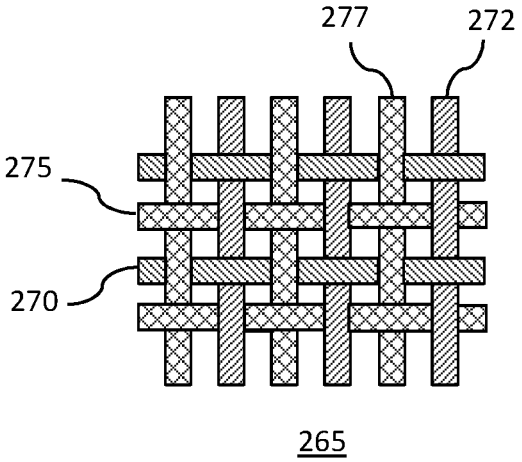
FIG. 7 shows a schematic plan view of an inter-woven para-aramid/metal fiber fabric of one embodiment of the present invention.

FIG. 7 shows a schematic plan view of an inter-woven para-aramid/metal fiber fabric 265 of one embodiment of the present invention.

As discussed above, applicant noted an unexpected 30-40% increase in the puncture resistance when microflex fabric layers 120 are combined with metal mesh layers 125. One conjecture is that this unexpected increase may be due to such a combination resulting in, even during low velocity puncture, more of the para-aramid fibers being stretched or broken along a longitudinal axis of the fiber, rather than being broken in shear.

Para-aramid fibers typically have a tensile strength of about 36% more than an equivalent dimensioned steel fiber. As para-aramids are typically only about 18% as dense as steel, this gives them a tensile strength advantage of about a factor of 5, which is why they are often cited as being "five times as strong as steel". However, para-amid fiber typically have a shear strength that is only about 24% of that of steel. This means that they are much easier to cut or to stab through with either a sharp instrument or a needle. A conjecture for the unexpected 30-40% increase in the puncture resistance when microflex fabric layers 120 are combined with metal mesh layers 125 is that the para-amid fibers are being bent and then stretched through the metal mesh. This would allow a fraction of their superior tensile strength to come into effect even in resisting a low velocity puncture, cut or needle attack.

A similar synergy of the properties of metal and para-aramid fibers may, therefore, also be possible by weaving the fibers into a single layer of fabric.

In the inter-woven para-aramid/metal fiber fabric 265 shown in FIG. 7, the fabric has alternating warp para-aramid yarn fibers 272 and warp metal fibers 277 as well as alternating weft para-aramid yarn fibers 270 and weft metal fibers 275. One of ordinary skill in the art will, however, appreciate that alternate types of weaving could also be used to create such a composite such as, but not limited to, having all para-aramid yarn weft fibers and all metal warp fibers, or vice versa. In addition to the plain weave pattern illustrated in FIG. 7, other well-known weave patterns such as, but not limited to, a basket weave, a twill weave or a statin weave, or some combination thereof, may be used as some may provide possible advantageous results regarding protection-to-material ratios, or cost advantages.

In a preferred embodiment, the inter-woven para-aramid/metal fiber fabric 265 may be made of para-aramid yarn made of a plurality of individual poly-p-phenylene terephthalamide fibers having a denier of 2 dtex or less, while the metal fibers may be stainless steel fibers having a diameter of 0.2 mm or less.

In a further preferred embodiment of the invention, the inter-woven para-aramid/metal fiber fabric 265 may be woven such the mesh aperture is 0.45 mm or less.

Figure 8:
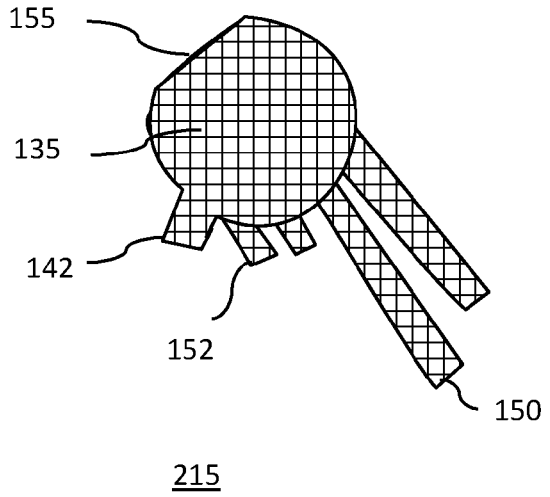
FIG. 8 shows a schematic, plan view of a folded, elephant pattern layer of one embodiment of the present invention having a truncated thumb extension and truncated finger extensions.

FIG. 8 shows a schematic, plan view of a folded, elephant pattern layer of one embodiment of the present invention having a truncated thumb extension and truncated finger extensions.

The folded, elephant pattern layer 215 of FIG. 8 is shown as having a first palm region 135 with a truncated thumb extension 142. The pattern may be folded at a lower palm edge 155 that may be connected to a second palm region (not shown in this view) that may have one or more finger extensions 150 and one or more truncated finger extensions 152 attached to it.

A purpose of having one or more metal mesh layers or one more para-aramid layers of the protective material having either a truncated finger or thumb extension may be to allow additional flexibility of a wearer's corresponding digits. The glove may, for instance, be used by an agent wanting to use a firearm while wearing the glove. Having additional flexibility and less bulk in the thumb and index fingers of a glove may, for instance, allow a wearer to hold and fire a pistol more easily.

In an alternate version of the glove with truncated protection, there may be additional pieces of material sized and shaped to cover the remainder of the finger of thumb but that are disconnected from the rest of the elephant pattern. In that manner, flexibility may be maintained while protection may be provided for the majority of the thumb and finger.

Figure 9A:
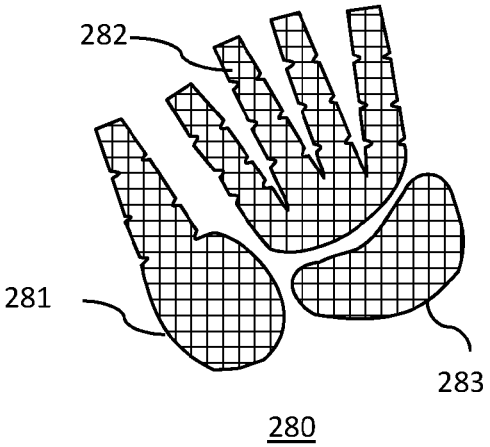
FIG. 9 A shows a schematic, plan view of a fan, 3-piece glove pattern cut-out of one embodiment of the present invention.
Figure 9B:
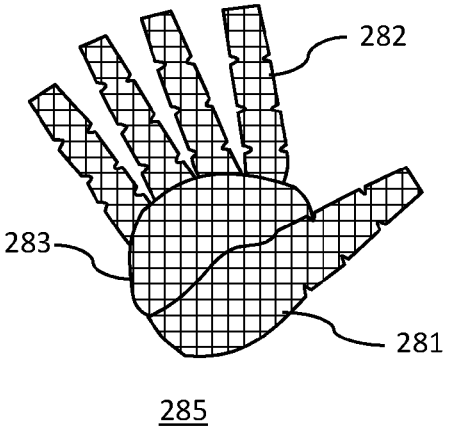

FIG. 9 A shows a schematic, plan view of a fan, 3-piece glove pattern 280 cut-out of one embodiment of the present invention.

As shown, the fan, 3-piece glove pattern 280 may have a thumb piece of a fan glove pattern 281, a fingers piece of a fan glove pattern 282 and a palm piece of a fan glove pattern 283. The fan, 3-piece glove pattern 280 may be used to cut either microflex fabric layers or metal mesh layers, or both. In a preferred embodiment, the fan, 3-piece glove pattern 280 pieces may be arranged such that either, or both, of the thumb and finger extensions are bias-cut for reasons such as those described above.

FIG. 9 B shows a schematic, plan view of an assembled fan, 3-piece glove pattern 285 of one embodiment of the present invention. The thumb piece 281, the fingers piece 282 and the palm piece 283 may be assembled together by any suitable means such as, but not limited to, stitching, gluing, stapling, welding, spot gluing, spot stitching, spot welding or some combination thereof. The pieces may also, or instead, be held in place by suitably shaped inner and outer protective layers that may be joined peripherally by, for instance, stitching, or which may be joined by stitching that extends across the interior of the pattern.

Figure 10A:
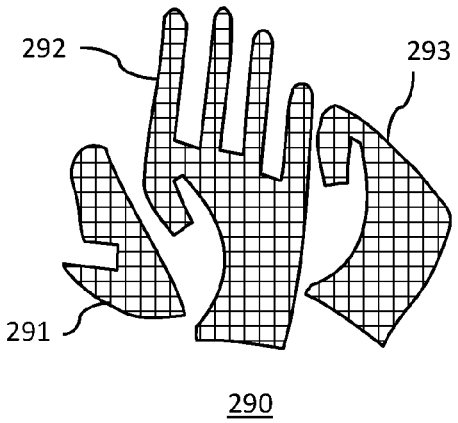
FIG. 10 A shows a schematic, plan view of a turkey, 3-piece glove pattern cut-out of one embodiment of the present invention.
Figure 10B:
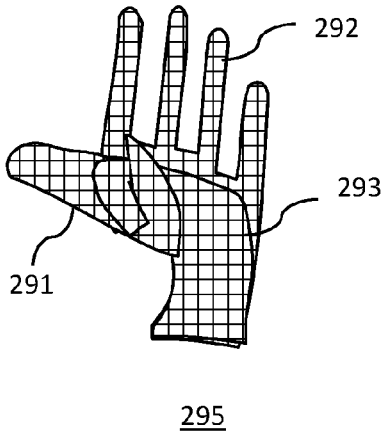

FIG. 10 A shows a schematic, plan view of a turkey, 3-piece glove pattern 290 cut-out of one embodiment of the present invention.

As shown, the turkey, 3-piece glove pattern 290 may have a thumb piece of a turkey glove pattern 291, a fingers piece of a turkey glove pattern 292 and a palm piece of a turkey glove pattern 293. The fan, 3-piece glove pattern 290 may be used to cut either microflex fabric layers or metal mesh layers, or both. In a preferred embodiment, the turkey, 3-piece glove pattern 290 pieces may be arranged such that either, or both, of the thumb and finger extensions are bias-cut for reasons such as those described above.

FIG. 10 B shows a schematic, plan view of an assembled turkey, 3-piece glove pattern second pivot 295 of one embodiment of the present invention. The thumb piece 291, the fingers piece 292 and the palm piece 293 may be assembled together by any suitable means such as, but not limited to, stitching, gluing, stapling, welding, spot gluing, spot stitching, spot welding or some combination thereof. The pieces may also, or instead, be held in place by suitably shaped inner and outer protective layers that may be joined peripherally by, for instance, stitching, or which may be joined by stitching that extends across the interior of the pattern.

Figure 11:
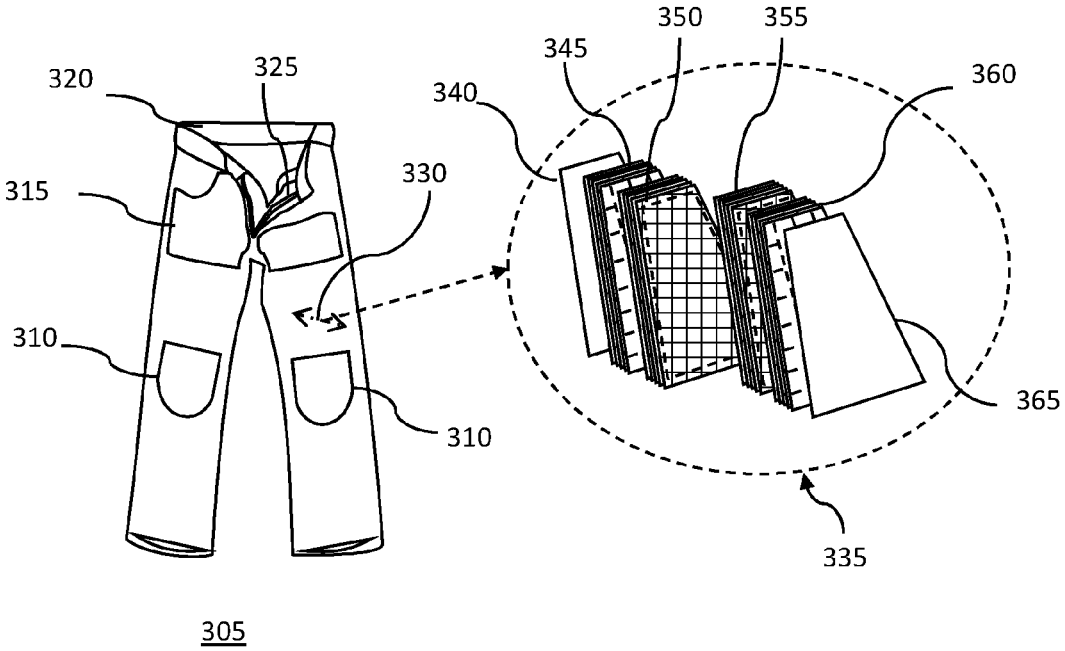
FIG. 11 shows a schematic, front view of a protective pants of one embodiment of the present invention along with a schematic view of a composite fabric construction at a line of section.

FIG. 11 shows a schematic, front view of a pair of protective pants 305 of one embodiment of the present invention along with a schematic view of a composite fabric construction 355 viewed at a line 330.

The protective pants 305 may, for instance, be of a conventional design having features such as, but not limited to, a pant belt 320 and a zipper fastener 325 or some combination thereof. The protective pants 305 may be fabricated in whole or in part of a composite fabric of the present invention having a composite fabric construction 335 as illustrated schematically in FIG. 11.

The composite fabric construction 335 may, for instance, be illustrative of the construction at line of section 330 on the protective pants. The composite fabric construction 335 may include an inner lining fabric 340, an inner, microflex bundle 345, an inner metal mesh bundle 350, an outer metal mesh bundle 355, an outer microflex bundle 360 and an outer lining fabric 365.

In a preferred embodiment, the inner, microflex bundle 345 and the inner metal mesh bundle 350 may be joined together, but may be separate from the outer metal mesh bundle 355 and the outer microflex bundle 360, which may themselves be joined together. The two separated, inner and outer groups of bundles may then be sandwiched between the inner lining fabric 340 and the outer lining fabric 365 which may be joined at the periphery of the sections making up the garment.

The microflex bundle layers may, for instance, be joined to each other by stitching extending across the interior of said microflex fabric layers, while the metal mesh bundle layers may, for instance, be joined by stitching along a periphery of the metal mesh layers.

In an alternative embodiment, the inner and outer linings may also be joined directly to the inner and outer groups of fabric bundles.

The inner and outer microflex bundles may be made of microflex fabric layers of woven para-aramid yarn, and may comprise para-aramid yarn having some or all of the characteristics of the types of para-aramid yarns and fibers detailed above.

The inner and outer metal mesh bundles may be made of woven stainless steel fibers, and may comprise metal mesh layers having fiber composition and characteristics of some or all of the metal meshes described above.

In a preferred embodiment of the present invention, each of the inner and outer microflex bundles and the inner and outer metal mesh bundle may have 3 to 8 layers of fabric. In a further preferred embodiment of the invention, each of the inner and outer microflex bundles and the inner and outer metal mesh bundle may have 5 layers of fabric, with the microflex layers being woven from para-aramid fibers that may be poly-p-phenylene terephthalamide fibers having a fiber dernier of 2 dtex or less that may be bundled, for weaving, into a yarn having 500 or more fibers, and the metal mesh layer being made of woven mesh of stainless steel fibers having a diameter of 0.2 mm or less and a mesh aperture of 0.45 mm or less.

As shown in FIG. 11, the protective pants 305 may include regions of extra protection such as, but not limited to, the knee region of additional protection 310 and/or the crotch region of additional protection 315. Having regions of extra protection may, for instance, allow garments to be made cost effectively while providing the desired levels of protection in the regions most in need of protection.

Various embodiments of the present invention have been described above primarily with reference to garments that are protective gloves, protective vests, protective trousers and protective leggings. One of ordinary skill in the art will, however, appreciate that the materials and methods of the invention described above may all also be applied to a wide range of protective garments including, but not limited to, protective headgear, protective sleeves, protective knee guards, protective shoe covers, protective shoe soles and protective boots. In addition, the materials described above may be used to provide protective garments for animals such as, but not limited to, police dogs and horses. In addition the materials described above may also be used to provide protective structures for protecting vulnerable items such as, but not limited to, portable electronic devices, computers, piping, electronics, portions of vehicles and liquid carrying containers.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A human wearable glove, comprising:

an inner protective layer;

an outer protective layer;

one or more microflex fabric layers, said microflex fabric being comprised of woven para-aramid yarn, said yarn comprising poly-p-phenylene terephthalamide fibers having a denier of 2 dtex or less; and one or more mesh layers of a woven metallic mesh, said woven metallic mesh comprising stainless steel fibers having a diameter of 0.2 mm or less and a mesh aperture of 0.45 mm or less; and wherein said microflex fabric layer and said metal mesh layer are sandwiched between said inner and outer protective layers, and wherein said inner and outer protective layers are joined at a periphery of said protective layers, and wherein said metal mesh layer is shaped in the form of an elephant-pattern, said elephant-pattern comprising a first palm region having a thumb extension, and a second palm region having four finger extensions and wherein said first and second palm regions are joined along a lower palm edge, and wherein said metal mesh layer is bias-cut with respect to a direction of at least one of said finger extensions and wherein said metal mesh layer is folded along a lower palm edge of said elephant-pattern when located within said glove.

2. The glove of claim 1 wherein at least one of said microflex fabric layers is shaped in the form of an elephant-pattern and is bias-cut with respect to a direction of at least one of said finger extensions.

3. The glove of claim 1 further comprising four of said folded, bias-cut, elephant-pattern shaped mesh layers and one of said microflex layers.

4. The glove of claim 3 further comprising a second microflex layer and wherein said folded, bias-cut elephant-pattern shaped mesh layers are sandwiched between said two microflex layers.

5. The glove of claim 2 wherein said microflex layer is sandwiched between said folded, bias-cut elephant-pattern shaped mesh layers such that there are two of said mesh layers on either side of said microflex layer.

6. The glove of claim 2 wherein at least one of said finger extensions is a truncated finger extension.

* * * * *